US006889017B2

(12) United States Patent
Park et al.

(10) Patent No.: US 6,889,017 B2
(45) Date of Patent: May 3, 2005

(54) IMAGE FORMING APPARATUS AND CONTROL METHOD THEREOF

(75) Inventors: Jong-hwa Park, Suwon (KR); Woo-jung Shim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 4 days.

(21) Appl. No.: 10/612,054

(22) Filed: Jul. 3, 2003

(65) Prior Publication Data

US 2004/0018025 A1 Jan. 29, 2004

(30) Foreign Application Priority Data

Jul. 23, 2002 (KR) ..... 10-2002-0043415

(51) Int. Cl.[7] ..... G03G 15/06
(52) U.S. Cl. ..... 399/55
(58) Field of Search ..... 399/38, 44, 46, 399/53, 55

(56) References Cited

U.S. PATENT DOCUMENTS 5,315,353 A * 5/1994 Simazaki et al. ..... 399/53

* cited by examiner

*Primary Examiner*—Hoan Tran
(74) *Attorney, Agent, or Firm*—Staas & Halsey LLP

(57) ABSTRACT

An image forming apparatus has developing rollers mounted to be spaced-apart from a photo-sensitive body and supplying a developing agent to the photo-sensitive body, a bias-applying part applying a predetermined bias to the developing rollers through respective current-conducting paths to the photo-sensitive body from the developing rollers, a current detection part detecting a current flowing through the developing rollers in accordance with a bias applied from the bias-applying part, and an engine control part applying a first test AC voltage having a set first frequency to the developing rollers, controlling the bias-applying part to apply a second test AC voltage having a set second frequency to the developing rollers, calculating a resistance of the developing rollers and a gap between the developing rollers and the photo-sensitive body using a current value detected from the current detection part respectively corresponding to the first and second frequencies, and setting a bias voltage of a driving condition corresponding to the resistance of the developing rollers and the gap which are calculated as a developing bias voltage in a printing mode.

24 Claims, 11 Drawing Sheets

IMAGE FORMING APPARATUS AND CONTROL METHOD THEREOF

CROSS-REFERENCE TO RELATED APPLICATIONS

This application claims the benefit of Korean Patent Application No. 2002-43415, filed Jul. 23, 2002, in the Korean Intellectual Property Office, the disclosure of which is incorporated herein by reference.

BACKGROUND OF THE INVENTION

1. Field of the Invention

The present invention relates to an image forming apparatus and a control method thereof, and more particularly, to an image forming apparatus and a control method thereof capable of precisely measuring electrical characteristics changes of factors relating to developing conditions of a developing apparatus and applying the developing conditions required for stably maintaining a printing quality to the developing apparatus.

2. Description of the Related Art

Printers, such as an image forming apparatus, may be mainly classified into an inkjet printer and an electrostatic latent image printer.

The electrostatic latent image printer is provided with a photo-sensitive body, a photo-scanning device, a developing device, and a transfer device.

The developing device of the electrostatic latent image printer has developing rollers mounted in a predetermined space around the photo-sensitive body, and a developing agent-supplying device capable of supplying a developing agent through the space between the photo-sensitive body and the developing rollers during rotations of the developing rollers.

In the developing device, it is important to uniformly supply the developing agent to the photo-sensitive body from the developing rollers in order to maintain a print quality. An AC voltage is generally applied between the developing rollers and the photo-sensitive body in order to smoothly supply the developing agent from the developing rollers to the photo-sensitive body. However, a supply amount of the developing agent to the photo-sensitive body may vary according to changes of the space between the developing rollers and the photo-sensitive body (hereinafter referred to as a "developing gap") in response to an AC voltage applied between the developing rollers and the photo-sensitive body.

U.S. Pat. No. 5,521,683 discloses a printer applying variable AC voltages to the developing rollers based on such changes to the developing gap. However, the printer disclosed in the U.S. Pat. No. 5,521,683 uses only the developing gap as a factor affecting developing currents. Namely, the printer applies a test voltage to the developing rollers and then measures a developing current flowing from the developing rollers to the photo-sensitive body, calculates from a lookup table the developing gap corresponding to the measured developing current, and determines a driving bias to be applied to the respective developing rollers in accordance with the developing gap. However, in addition to the developing gap, a resistance value may be a factor affecting the developing current flowing to the photo-sensitive body from the developing rollers. Since the resistance value of the developing rollers generally varies according to temperature and humidity changes, data on the developing gap obtained with only an effective value of the developing current may not precisely control the driving bias to be supplied to the developing rollers. As a result, a problem of difficulties in optimizing developing conditions occurs. In particular, the changes of the resistance value of the developing rollers affect the developing current more than the developing gap.

SUMMARY OF THE INVENTION

An aspect of the present invention is to solve at least the above and/or other problems and/or disadvantages and to provide at least the advantages described hereinafter.

Accordingly, another aspect of the present invention is to solve the foregoing problems by providing an image forming apparatus and a control method thereof capable of precisely diagnosing factors relating to developing conditions and optimizing the developing conditions.

Additional aspects and advantages of the invention will be set forth in part in the description which follows and, in part, will be obvious from the description, or may be learned by practice of the invention.

In order to achieve the above and/or other aspects of the present invention, an image forming apparatus according to an embodiment of the present invention comprises developing rollers mounted to be spaced-apart from a photo-sensitive body and supplying a developing agent to the photo-sensitive body, a bias-applying part applying a predetermined bias to the developing rollers through respective current-conducting paths to the photo-sensitive body from the developing rollers, an engine control part controlling the bias-applying part to generate a bias, and a current detection part detecting a current flowing through the developing rollers in response to the bias supplied from the bias-applying part. The engine control part controls the bias-applying part to supply a first test AC voltage having a set first frequency to the developing rollers and supply a second test AC voltage having a set second frequency to the developing rollers, calculates a resistance of the developing rollers and a developing gap between the developing rollers and the photo-sensitive body in accordance with a current value detected from the current detection part respectively corresponding to the frequencies, and controls the bias-applying part to supply the developing rollers with a bias voltage of a driving condition according to the calculated resistance of the developing rollers and the calculated developing gap.

According to another aspect of the present invention, the engine control part controls the bias-applying part to supply a set test AC voltage to the developing rollers, calculates a resistance of the developing rollers and a developing gap in accordance with information on a phase difference between the developing current outputted from the current detection part and the set test AC voltage, and controls the bias-applying part to supply the developing rollers with a bias of a driving condition according to the resistance of the developing rollers and the developing gap.

According to another aspect of the present invention, the engine control part controls the bias-applying part to supply a set test AC voltage to the developing rollers, calculates a resistance of the developing rollers and a developing gap by analyzing data of currents outputted from the current detection part in accordance with developing current values corresponding to predetermined first and second times after a reference time on which a current peak value occurs, and controls the bias-applying part to supply the developing rollers with a bias of a driving condition according to the calculated resistance of the developing rollers and the calculated developing gap.

Further, in order to achieve the above and/or other aspects, a method of controlling an image forming apparatus according to another embodiment of the present invention controls an image forming apparatus having developing rollers mounted to be spaced-apart from a photo-sensitive body and to supply a developing agent to the photo-sensitive body, a bias-applying part supplying a predetermined bias to the developing rollers through respective current-conducting paths to the photo-sensitive body from the developing rollers, and an engine control part controlling the bias-applying part. The method comprises supplying a first test AC voltage having a set first frequency to the developing rollers, detecting a developing current flowing through the developing rollers in response to the first test AC voltage, supplying a second test AC voltage having a set first frequency to the developing rollers, detecting a developing current flowing through the developing rollers in response to the second test AC voltage, calculating a resistance of the developing rollers and a developing gap in accordance with data of the first and second test AC voltages and data of the developing currents detected in response to the respective first and second test AC voltages, and supplying the developing rollers with a bias voltage of a driving condition according to the calculated resistance of the developing rollers and the calculated developing gap.

Further, a method of controlling an image forming apparatus according to another embodiment of the present invention comprises supplying a set test AC voltage to the developing rollers, detecting a current flowing through the developing rollers in response to the set test AC voltage, calculating a resistance of the developing rollers and a developing gap in accordance with information on a phase difference between the set test AC voltage and the detected current, and supplying the developing rollers with a bias of a driving condition according to the calculated resistance of the developing rollers and the calculated developing gap.

Further, a method of controlling an image forming apparatus according to another embodiment of the present invention comprises supplying a set test AC voltage to the developing rollers, storing data of a developing current flowing through the developing rollers for a predetermined period of time in response to the set test AC voltage, calculating a resistance of the developing rollers and a developing gap in accordance with the developing current corresponding to the respective first and second times after a predetermined time with reference to a time on which a peak value occurs from the stored developing current data, and supplying the developing rollers with a bias of a driving condition according to the calculated resistance of the developing rollers and the calculated developing gap.

BRIEF DESCRIPTION OF THE DRAWINGS

These and/or other aspects, advantages, and other features of the present invention will become more apparent and more readily appreciated from the following description of the preferred embodiments thereof, taken in conjunction with the accompanying drawings of which.

DETAILED DESCRIPTION OF THE PREFERRED EMBODIMENTS

Figure 1:
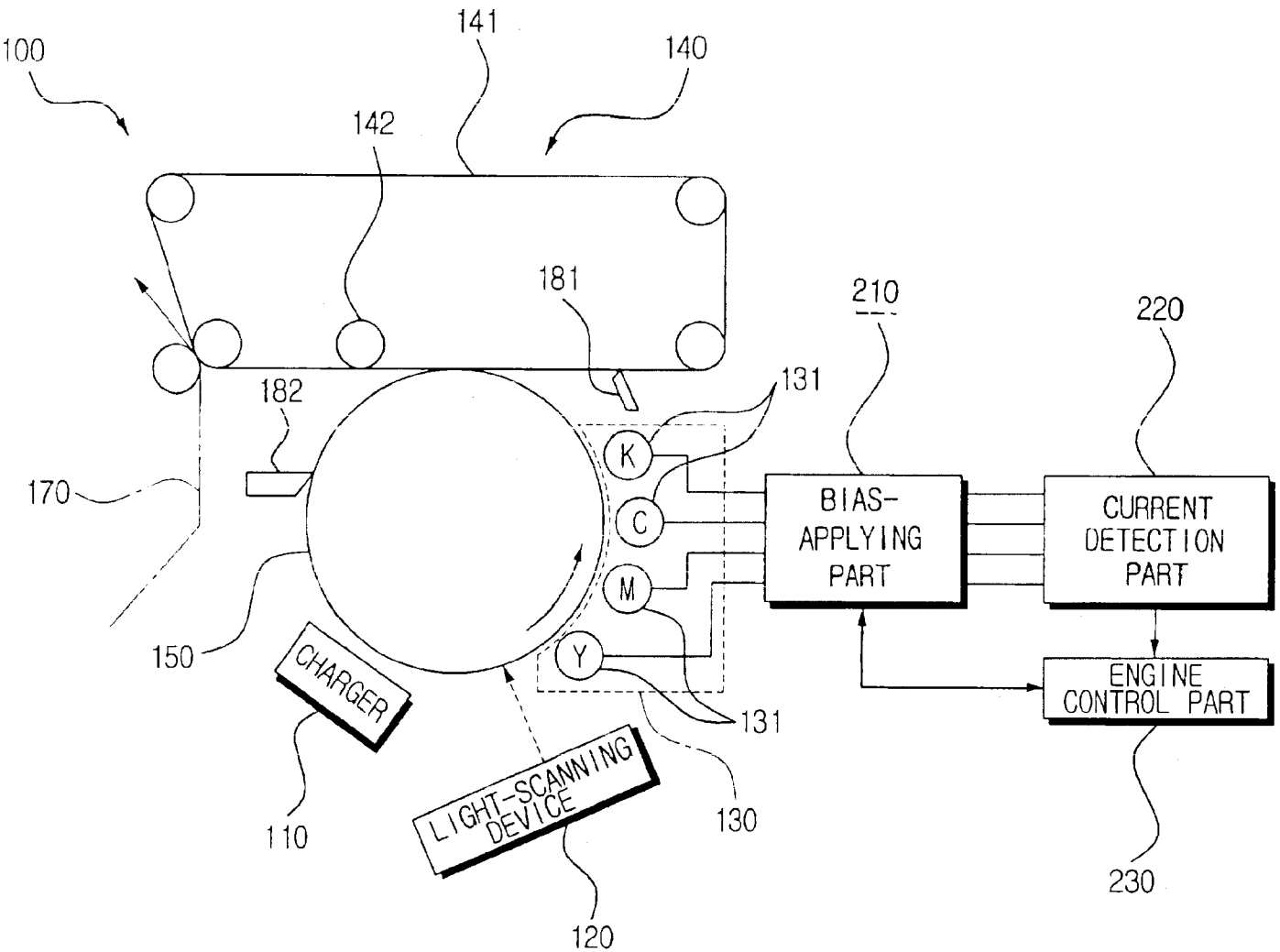
FIG. 1 is a view schematically showing a printer according to an embodiment of the present invention.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

FIG. 1 is a view schematically showing a printer 100 according to an embodiment of the present invention. Referring to FIG. 1, the printer 100 is provided with a charger 110, a light-scanning device 120, a developing device 130, and a transfer device 140.

The charger 110 charges a photo-sensitive drum 150 of a photo-sensitive body to a predetermined voltage. The light-scanning device 120 scans the photo-sensitive drum 150 with light corresponding to printing data. The developing device 130 has developing rollers 131 independently supplying yellow, magenta, cyan, and black color developing agents to the photo-sensitive drum 150, respectively.

The developing rollers 131 are arranged to be spaced-apart from the photo-sensitive drum 150 by a predetermined interval during a printing mode and supply respective developing agents to the photo-sensitive drum 150 during respective rotations thereof. A developing agent supplier has been omitted since the developing agent supplier is well known, forms a set with the corresponding developing rollers, and supplies the developing agents, such as toner, between the developing rollers 131 and the photo-sensitive drum 150. The developing agent supplier is a device supplying a certain amount of the developing agents to the corresponding developing rollers 131. The developing agent supplier has a blade (not shown) regulating the amount of the developing agents supplied to a supply roller which supplies the toner, e.g., each developing agent, to the corresponding developing rollers 131. The supply roller is supplied with a relatively low voltage compared to a voltage supplied by a bias-applying part 210. For example, in a case of the toner having a negative polarity, the supply roller is supplied with a voltage ranging from 100 to 200 volts.

The transfer device 140 transfers an image formed on the photo-sensitive drum 150 to a transfer belt 141 which is in a state of endless track movements using plural rollers, and also transfers the transferred image on a recording paper inserted through a paper-feeding path 170. A roller 142 is connected to a voltage source (not shown) supplying a predetermined voltage to the roller 142 to enhance a transfer efficiency of the transfer device 140.

The printer includes cleaning devices 181, 182 respectively contacting the transfer belt 141 and the photo-sensitive drum 150 to remove contaminants from the transfer belt 141 and the photo-sensitive drum 150.

The bias-applying part 210 is controlled by an engine control part 230 to enable predetermined biases to be variably applied to the developing rollers 131, respectively.

The current detection part 220 detects currents (hereinafter referred to as "developing currents") flowing to the photo-sensitive drum 150 through the developing rollers 131 from the bias-applying part 210, and outputs detected developing current data to the engine control part 230.

Figure 2:
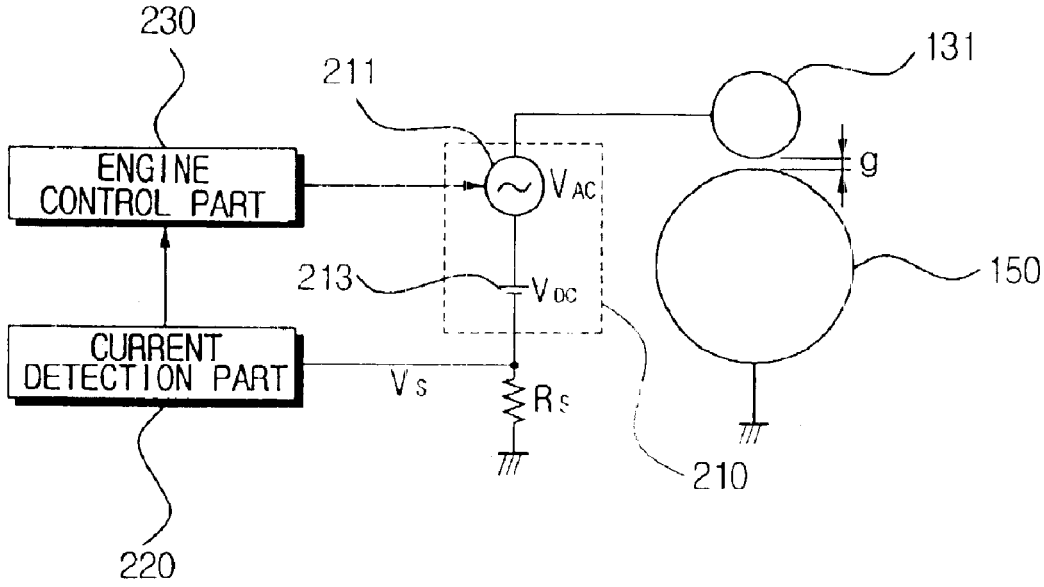
FIG. 2 is a view showing a circuit of a bias-applying part of the printer shown in FIG. 1.

FIG. 2 shows a circuit of the bias-applying part 210 of the printer 100. In FIG. 2, the bias-applying part 210 has an AC driving source 211 and a DC voltage source 213. The AC driving source 211 and the DC voltage source 213 are connected in series to the developing rollers 131, the photo-sensitive drum 150, and a developing current detection resistor Rs to form a current loop.

The AC driving source 211 is controlled by the engine control part 230 and generates an AC voltage varying in a frequency, an amplitude, a duty, a waveform, and the like. Here, the waveform is referred to as a sine or rectangular waveform.

The current detection part 220 detects and outputs to the engine control part 230 a voltage signal corresponding to a developing current flowing through the developing current detection resistor Rs. The current detection part 220 can detect the developing current flowing in a wire of a current-passing path using an induction method. For example, a known current transformer may be used for a developing current detection mode of the induction method, and, in this case, the developing current detection resistor Rs may be omitted.

The engine control part 230 controls the bias-applying part 210 during a developing condition adjustment mode by calculating a bias condition for properly supplying a developing agent to the photo-sensitive drum 150, and controls the developing device 130 based on the calculated bias condition when a printing job is carried out.

Here, the developing condition adjustment mode can be set to automatically or manually select the developing condition adjustment mode through a key input part (not shown) of the printer or an external device. The developing condition adjustment mode may be, for example, selected upon finishing product assembly after replacements of developing device-related units. Further, the time when a time period for use expires and/or the time when the number of sheets of paper for the printing job reaches the set number may be set for a condition to select the automatic developing condition adjustment mode. In FIG. 2, $V_{AC}$ denotes the AC voltage outputted from the AC driving source, $V_{DC}$ denotes the DC voltage outputted from the DC voltage source, and a developing gap g is formed between the photo-sensitive drum 150 and each of the developing rollers 131.

Figure 3:
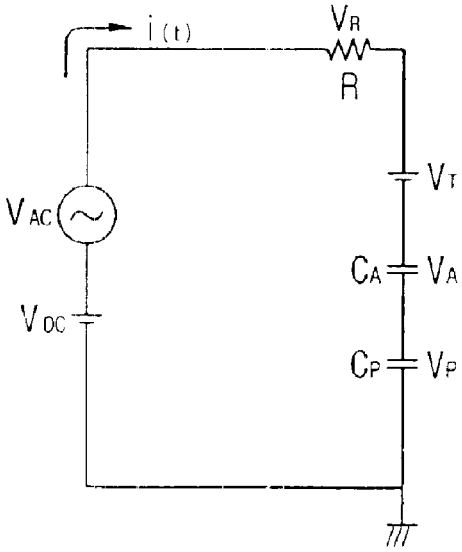
FIG. 3 is a view showing an equivalent circuit of the circuit of the bias-applying part shown in FIG. 2.

In the meantime, FIG. 3 shows a circuit equivalent to the current loop of FIG. 2 with the current detection resistor omitted. A reference numeral i(t) in FIG. 3 denotes an instant developing current at an instant time t, $V_R$ is a resistance for the developing rollers, Vt is a voltage of a developing agent layer determined by the developing agent attached on a surface of each developing roller 131, $C_A$ is an equivalent capacitance of the developing gap g, $V_A$ is a voltage generated by the equivalent capacitance $C_A$ of the developing gap g, Cp is an equivalent capacitance of the photo-sensitive drum 150, and Vp is a voltage generated by the equivalent capacitance Cp of the photo-sensitive drum 150.

The engine control part 230 calculates a resistance R of the developing rollers 131 and the developing gap g by analyzing the equivalent circuit, determines from a lookup table optimum developing bias data corresponding to values of the calculated resistance R of the developing roller 131 and the calculated developing gap g, and sets the data as developing driving condition data to be applied during the printing mode thereafter.

Prior to describing a process of calculating the resistance R of the developing rollers 131 and the developing gap g in the engine control part 230, an influence on the developing current i(t) by the resistance R of the developing rollers 131 and the developing gap g in the equivalent circuit of FIG. 3 is described with reference to FIG. 4 to FIG. 7. Although the influence and the process are explained in conjunction with one of the developing rollers 131 hereinafter, the following descriptions for the influence and the process are applied to all developing rollers 131. The developing rollers are collectively called a developing roller since the developing rollers 131 have the same structure and function.

Figure 4:
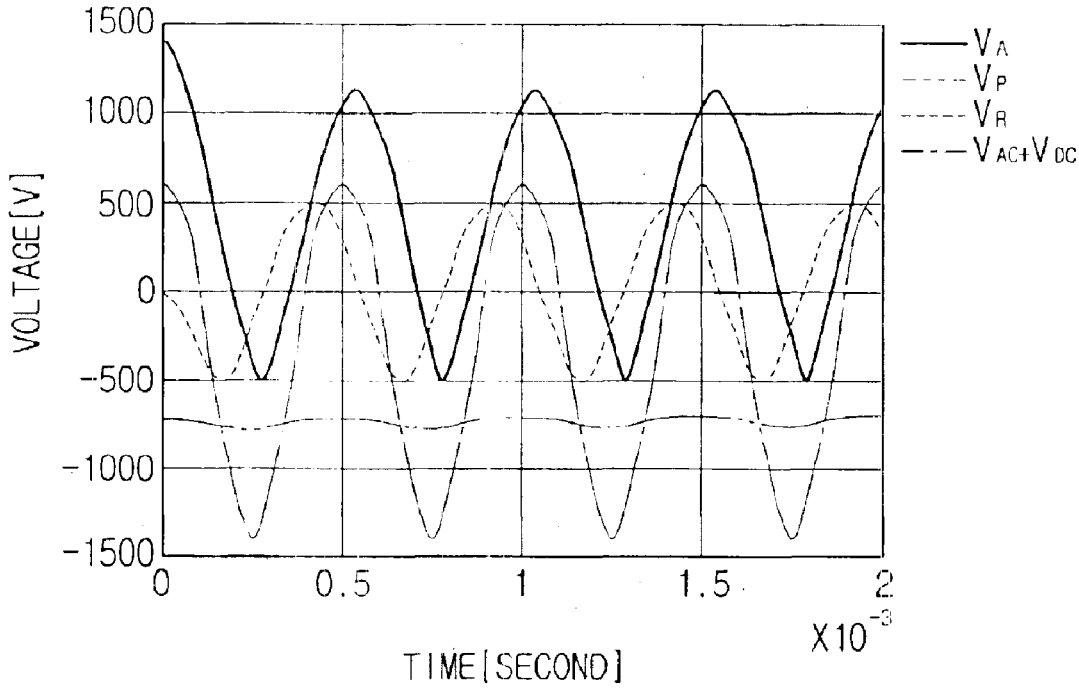
FIG. 4 is a view showing waveforms obtained through simulating voltage waveforms of respective elements of a current loop in response to a sine waveform voltage($V_{AC}$+$V_{DC}$) formed with superimposed waveforms generated from a dc voltage source and an AC voltage source of the equivalent circuit shown in FIG. 3, respectively.
Figure 5:
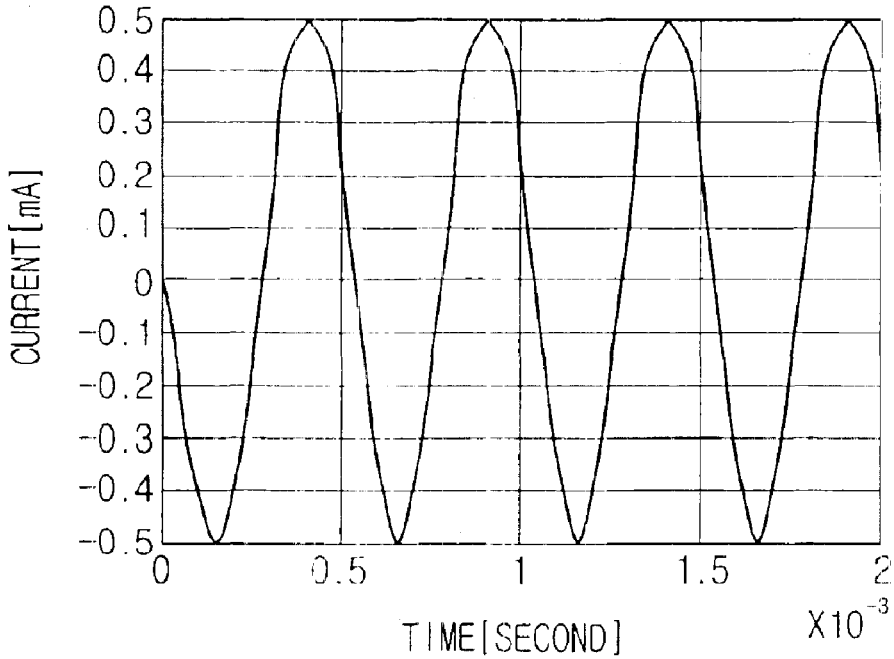
FIG. 5 is a view showing a waveform indicating a developing current measured in a bias application condition of the waveforms shown in FIG. 4.
Figure 6:
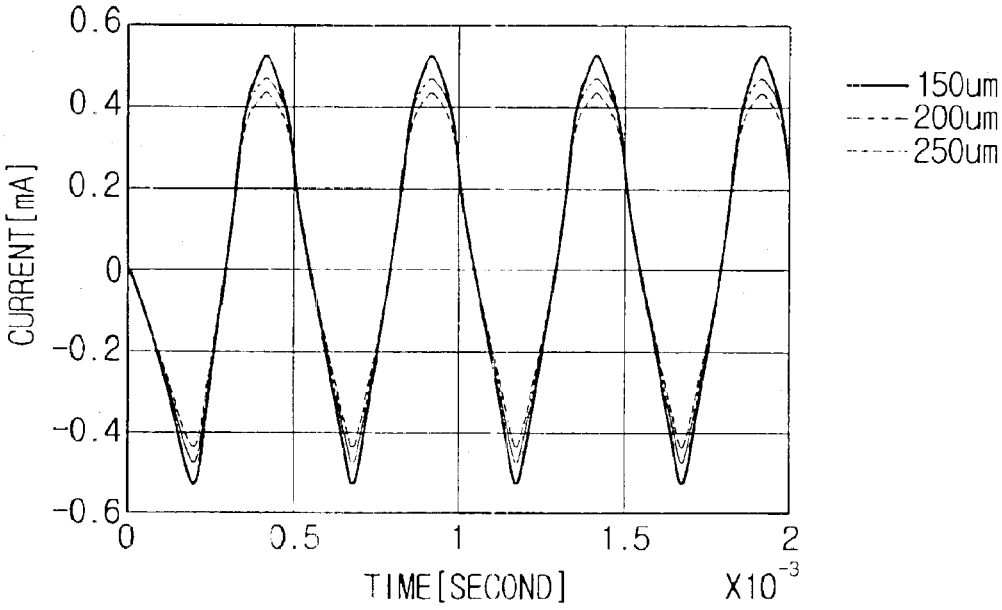
FIG. 6 is a view showing waveforms obtained from measurements of the developing current according to different developing gaps existing between a developing roller and a photo-sensitive body shown in FIG. 2.
Figure 7:
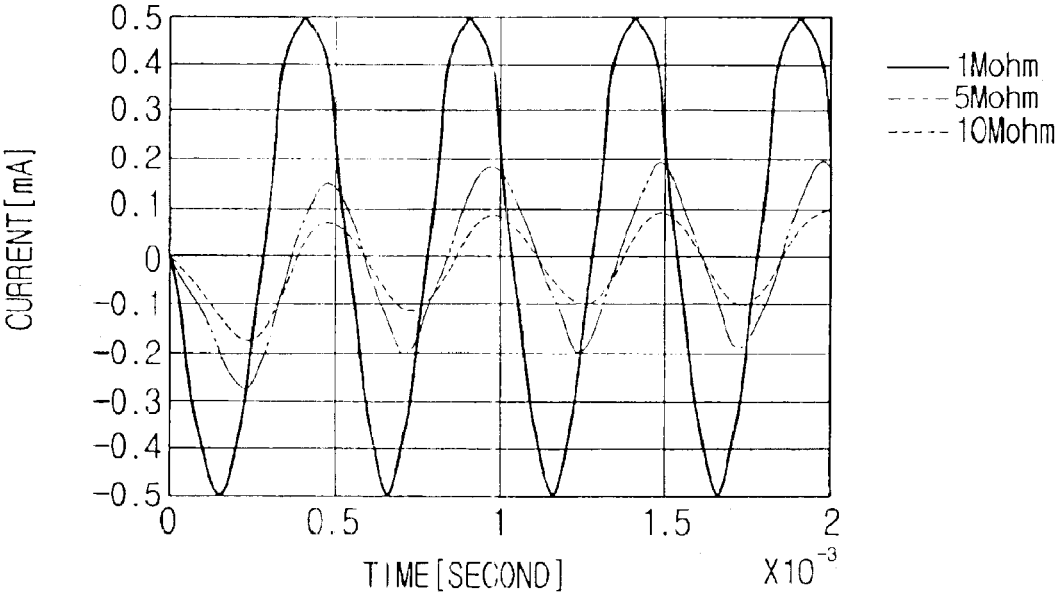
FIG. 7 is a view showing waveforms obtained from measurements of the developing current according to different resistances of the developing rollers shown in FIG. 3.

First, FIG. 4 shows voltage waveforms of respective elements in the current loop when a voltage ($V_{AC}$+$V_{DC}$) obtained by superimposing the voltages respectively produced from the DC voltage source 213 and the AC driving source 211 is generated, and FIG. 5 shows a graph obtained from measurements of the developing current i(t) in a bias application condition of the voltage waveforms shown in FIG. 4. FIG. 6 is a graph obtained from measurements of developing currents when the developing gap g is 150 $\mu$m, 200 $\mu$m, 250 $\mu$m, respectively, and FIG. 7 is a graph obtained from the measurements of the developing currents when the resistance R of the developing rollers 131 is 1MΩ, 5MΩ, and 10MΩ, respectively. As shown in the graphs of FIGS. 6 and 7, it can be seen that a first variation of the resistance R of the developing roller 131 affects the developing currents more than a second variation of the developing gap g.

Hereinafter, descriptions are made on a process of calculating the values of the resistance R of the developing roller 131 and the developing gap g through an analysis of the equivalent circuit of FIG. 3.

First, the developing current i(t) in the equivalent circuit is generated by the AC voltage source. Namely, a current due to a dc bias is not produced unless there are movements of the developing agent. Further, a developing electric field occurring due to only the dc bias applied to the developing gap g is generally very weak, so that it does not move the developing agent from the developing roller 131 to the photo-sensitive drum 150.

Accordingly, a capacitive reactance of the developing gap g becomes smaller with respect to a bias obtained from the superimposed voltages of the DC voltage and the AC voltage so that a considerable developing current i(t) flows owing to an equivalent impedance connected in series to the resistance R of the developing rollers 131. In a case that a non-image region of the photo-sensitive drum 150 passes through the developing gap g, since the current due to the dc bias does not occur, only a current based on the AC voltage flows. Further, when an image region of the photo-sensitive drum 150 passes through the developing gap g, the developing agent moves to the photo-sensitive drum 150 by an AC electric field, so a current corresponding to the movement of the developing agent is superimposed with the current produced by (based on) the AC voltage. However, the current due to the movement of the developing agent is generally less than 50 $\mu$m. Accordingly, the current due to the movement of the developing agent is considerably small enough to be ignored compared to the current (in general, a few miliamperes (mA)) occurring due to the AC voltage.

Meanwhile, another voltage source (not shown, a voltage source corresponding to a voltage $V_T$ produced by a developing agent layer of the developing rollers 131) different from the DC voltage source 213 in the equivalent circuit of FIG. 3 is applied to the equivalent circuit of FIG. 3 to generate a voltage of an extent of 20 to 50 V, which is small enough to be ignored compared to the bias produced by the superimposed voltages of the DC voltage source 213 and the AC driving source 211. Further, the capacitance Cp of the photo-sensitive drum 150 is generally more than 30 times compared to the capacitance CA of the developing gap g, so that, in a case that the capacitance CA of the developing gap 9 and the capacitance Cp of the photo-sensitive drum 150 are connected in series, a series equivalent capacitor is greatly affected by the capacitance CA of the developing gap g. Accordingly, the capacitance Cp of the photo-sensitive drum 150 can be ignored since it has an infinitesimal influence on the developing current i(t).

When such ignorable factors are excluded, the developing current i(t) can be expressed in the following Formula 1 and Formula 2.

$$i(t) = \frac{V_M}{\sqrt{R^2 + X^2}} \cos\left(2\pi f t - \tan^{-1}\left(\frac{X}{R}\right)\right) \quad \text{Formula 1}$$

$$I_M = \frac{V_M}{\sqrt{R^2 - X^2}} \quad \text{Formula 2}$$

Here, $V_M$ denotes an amplitude of the AC voltage($V_{AC}$) outputted from the AC driving source 211, $I_M$ is a maximum developing current, i(t) is the instant developing current, X a capacitive reactance $$\left(X = \frac{1}{2}\pi f C_A\right)$$

of the developing gap g, and f is a frequency of the AC voltage ($V_{AC}$).

By using Formula 1 and Formula 2, descriptions are made on a method of calculating the resistance R of the developing rollers 131 and the capacitance $C_A$ of the developing gap g.

First, AC test voltages having different frequencies are applied to the developing roller 131 in order to measure developing currents corresponding to the respective frequencies, are measured and then the resistance R of the developing rollers 131 and the developing gap g are calculated according to the developing currents.

In this case, relationships between impedances Z1 and Z2 with respect to a first frequency f1 and a second frequency f2 are expressed in the following Formula 3 and Formula 4.

$$Z_1 = \frac{V_M}{I_1} = \sqrt{R^2 + X_1^2} \quad \text{Formula 3}$$

$$Z_2 = \frac{V_M}{I_2} = \sqrt{R^2 + X_2^2}, \quad \text{Formula 4}$$

wherein $Z_1$ and $Z_2$ denote impedances in respective first and second frequencies f1 and f2, R is the resistance of the developing rollers 131, and $I_1$ and $I_2$ are maximum developing currents in respective first and second frequencies f1 and f2.

Meanwhile, X1 and X2 have relationships with the capacitance CA of the developing gap g as expressed in the following Formula 5 and Formula 6.

$$X_1 = \frac{1}{2\pi f_1 C_A} \quad \text{Formula 5}$$

$$X_2 = \frac{1}{2\pi f_2 C_A} \quad \text{Formula 6}$$

Accordingly, Formula 7 can be obtained by the capacitance $C_A$ of the developing gap by using Formula 3 to Formula 6 as below.

$$C_A = \sqrt{\frac{1}{4\pi(Z_2^2 - Z_1^2)}\left(\frac{1}{f_2^2} - \frac{1}{f_1^2}\right)} \quad \text{Formula 7}$$

Therefore, by using Formula 7, the capacitance $C_A$ of the developing gap g can be calculated from values of the impedances $Z_1$ and $Z_2$ that can be obtained and calculated through the current detection part 220 and the applied first and second frequencies f1 and f2.

Further, the resistance R of the developing roller 131 can be expressed as the following Formula 8 from Formula 3 and Formula 4.

$$R = \sqrt{Z_2^2 - X_2^2} = \sqrt{Z_1^2 - X_1^2} \quad \text{Formula 8}$$

Accordingly, a value of the resistance R of the developing roller 131 can be obtained by substituting in Formula 5 or Formula 6 the capacitance $C_A$ of the developing gap g calculated through Formula 7, calculating the capacitive reactance X1 or X2 of the developing gap g, and substituting the calculated value of the capacitive reactance X1 or X2 of the developing gap g in Formula 8.

Meanwhile, the developing gap g can be calculated using Formula 9 as below.

$$g=F(C_A) \quad \text{Formula 9}$$

In Formula 9, the relationship between the capacitance $C_A$ of the developing gap and the developing gap g can be calculated by using a function below together with a calculation method introduced in *The journal of Engineering Electronmagnetics, Hayt*, page 164:

$$C_A = \frac{2\pi\varepsilon LK}{\cosh^{-1}((R_a+g)/R_a)},$$

wherein L denotes a length of the developing roller 131, K is a factor compensating for a fringe effect, Ra is a radius of the developing rollers 131, and ∈ is a dielectric constant.

The engine control part 230, if the value of the resistance R of the developing roller 131 and the developing gap g are calculated using the above calculation method, determines from the lookup table a driving bias of an optimum condition corresponding to the calculated value of the resistance R of the developing roller 131 and the developing gap g and sets a developing driving condition.

Figure 8:
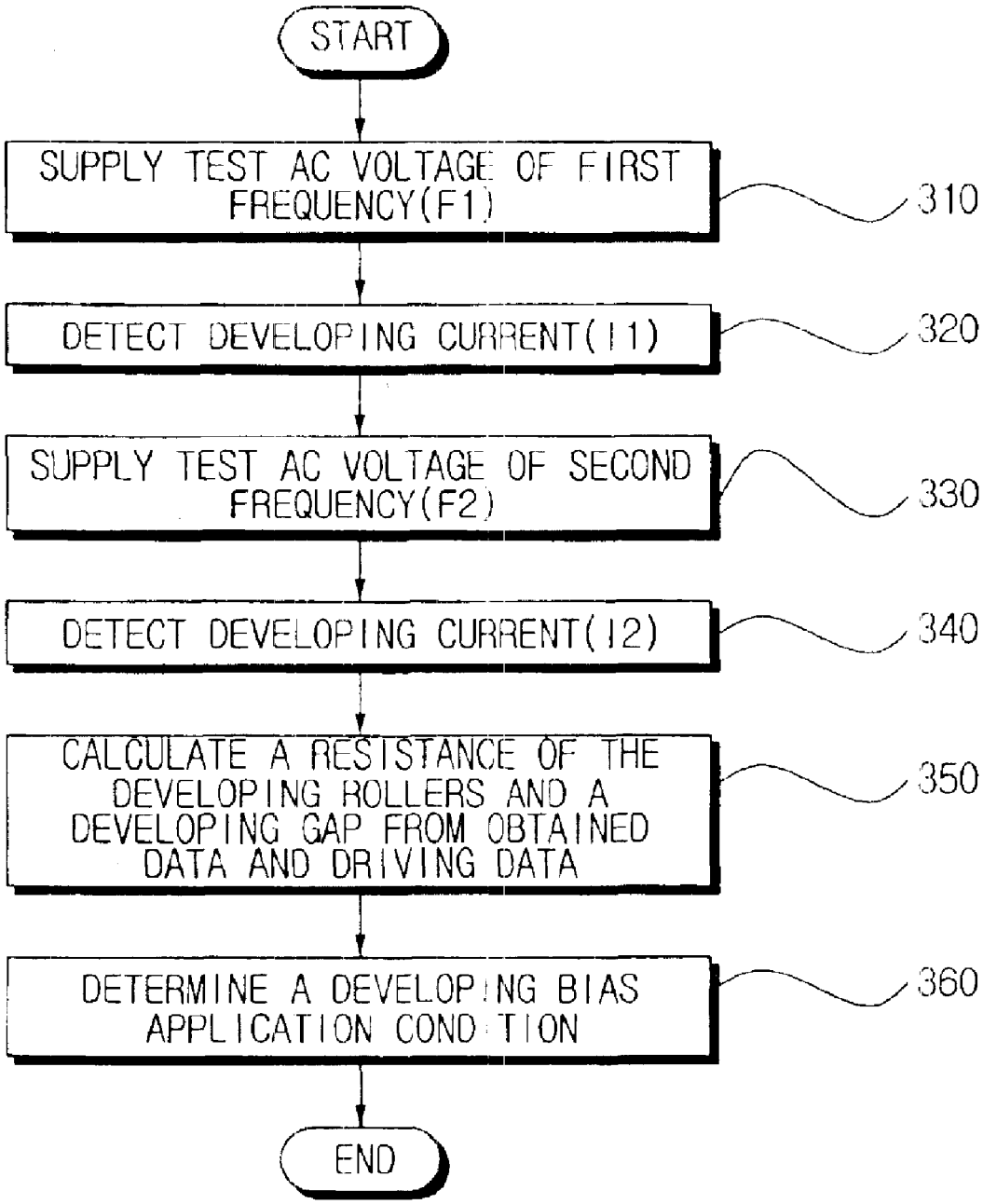
FIG. 8 is a flow chart showing a process determining a developing bias according to an embodiment of the present invention.

FIG. 8 shows a process determining a developing bias by such a method. First, the engine control part 230 applies a test AC voltage of a first frequency to the developing roller 131 in operation 310, and obtains a maximum value of a developing current i(t) detected with respect to an applied frequency in operation 320.

As stated above, the engine control part 230 applies a test AC voltage to the developing rollers 131 in operation 330, and obtains a maximum value of the developing current i(t) detected with respect to the applied first frequency in operation 340.

Here, it is possible that voltages of sinusoidal waveforms are used for the first and second test AC voltages if the first and second test AC voltages have the same amplitude and different frequencies.

Thereafter, the engine control part 230 calculates the resistance R of the developing roller 131 and the developing gap g by using the functions described through Formula 3 to Formula 9 from obtained data and driving data in operation 350.

The engine control part 230 determines a developing bias application condition corresponding to the calculated resistance R of the developing roller 131 and the developing gap g in operation 360. Here, the developing bias application condition determined in the operation 360 is referred to as a setting value (developing bias) as to the amplitude and the duty ratio of the AC voltage to be outputted in the AC driving source 211 in a printing mode for carrying out the printing job.

In the meantime, as another embodiment of the present invention, descriptions will be made on a method of calculating the resistance R of the developing roller 131 and the capacitance $C_A$ of the developing gap g from a difference between a phase of the AC voltage $V_{AC}$ and a phase of the developing current i(t).

First, a phase difference (ϕ) between a phase (ϕ1) of the developing current i(t) and a phase (ϕ2) of the AC voltage has the following relationship between the resistance R of the developing roller 131 and a capacitive reactance X of the developing gap g:

$$\phi=\phi_1-\phi_2=\tan^{-1}(X/R) \quad \text{Formula 10}$$

Further, an impedance can be expressed in an equation related to the resistance R of the developing roller 131 and the capacitive reactance X of the developing gap g, as shown in Formula 11 below:

$$Z=V_M/I=R^2+X^2 \quad \text{Formula 11}$$

Accordingly, using a value of the impedance Z and a value of the phase difference ϕ which can be obtained from the maximum value of first and second test developing current i(t) detected through the current detection part 220 and a value of the supplied AC voltage, the resistance R of the developing rollers 131 can be obtained by using the following Formula 12 below:

$$R=Z\cos(\phi) \quad \text{Formula 12}$$

Further, the capacitive reactance X of the developing gap g can be obtained from the following Formula 13 below, and the developing gap capacitance $C_A$ can be obtained through the following Formula 14 related thereto.

$$X=Z\sin(\phi) \quad \text{Formula 13}$$

$$C_A=1/(2\pi fX) \quad \text{Formula 14}$$

If the capacitance $C_A$ of the developing gap g is obtained, the developing gap g can be calculated by using preceding Formula 9.

Figure 9:
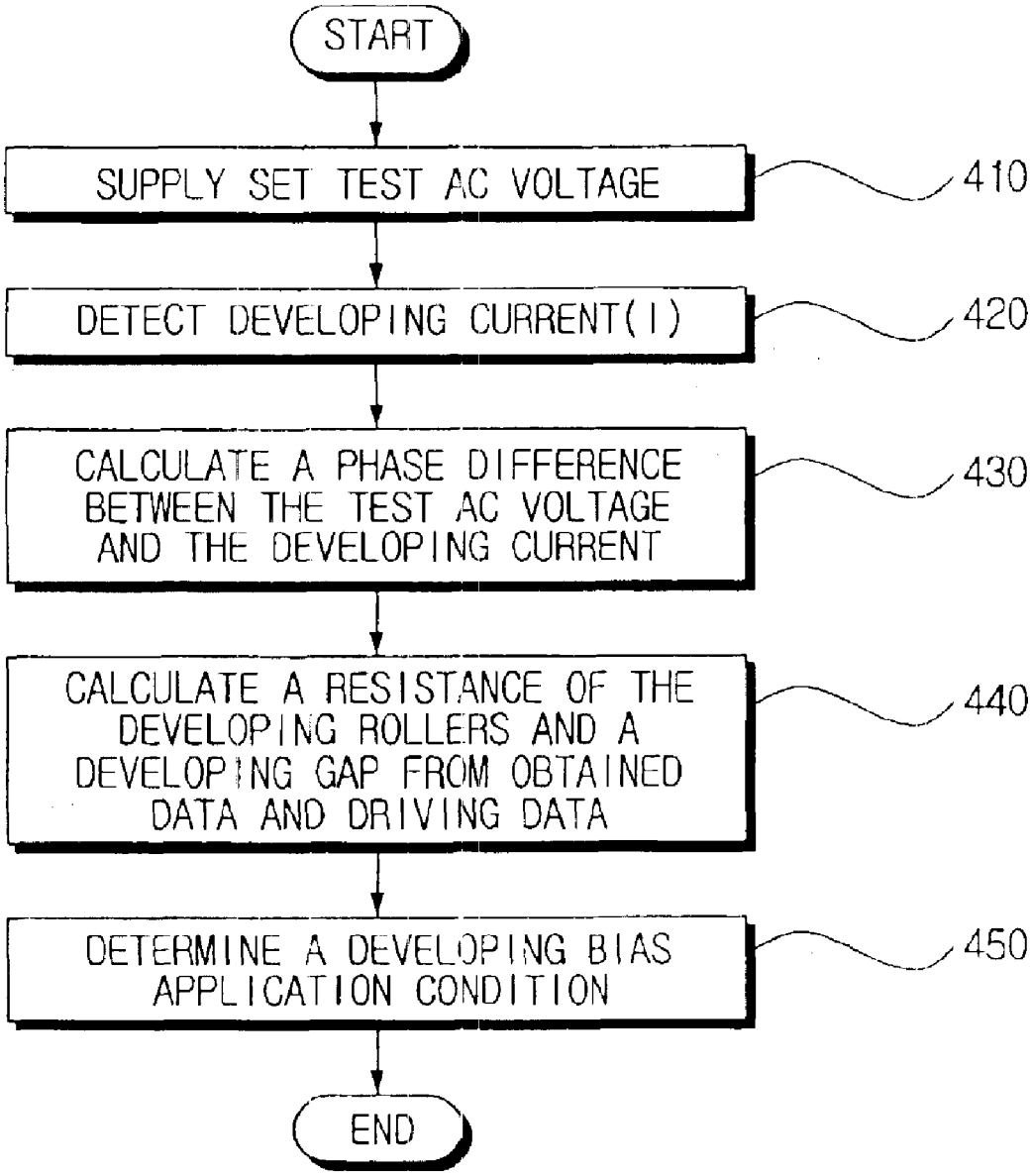
FIG. 9 is a flow chart showing a process determining a developing bias according to another embodiment of the present invention.

FIG. 9 shows a process of determining the developing bias of the developing bias application condition based on the above method of FIG. 8. First, the engine control part 230 applies a set test AC voltage to the developing roller 131 in operation 410, and detects a maximum value of the developing current i(t) detected as to the applied test AC voltage in operation 420.

Further, the engine control part 230 calculates a difference between a phase of the test AC voltage and a phase of the developing current i(t) in operation 430. The phase difference calculation uses information on a peak voltage-applying timing of the test AC voltage and a maximum value detection timing of the developing current i(t).

Thereafter, the engine control part 230 calculates the resistance R of the developing roller 131 and the developing gap g by the calculation method described through preceding Formula 10 to Formula 14 from obtained data and driving data in operation 440).

Further, the engine control part 230 determines the developing bias application condition corresponding to the calculated resistance R of the developing roller 131 and the developing gap g.

Figure 10:
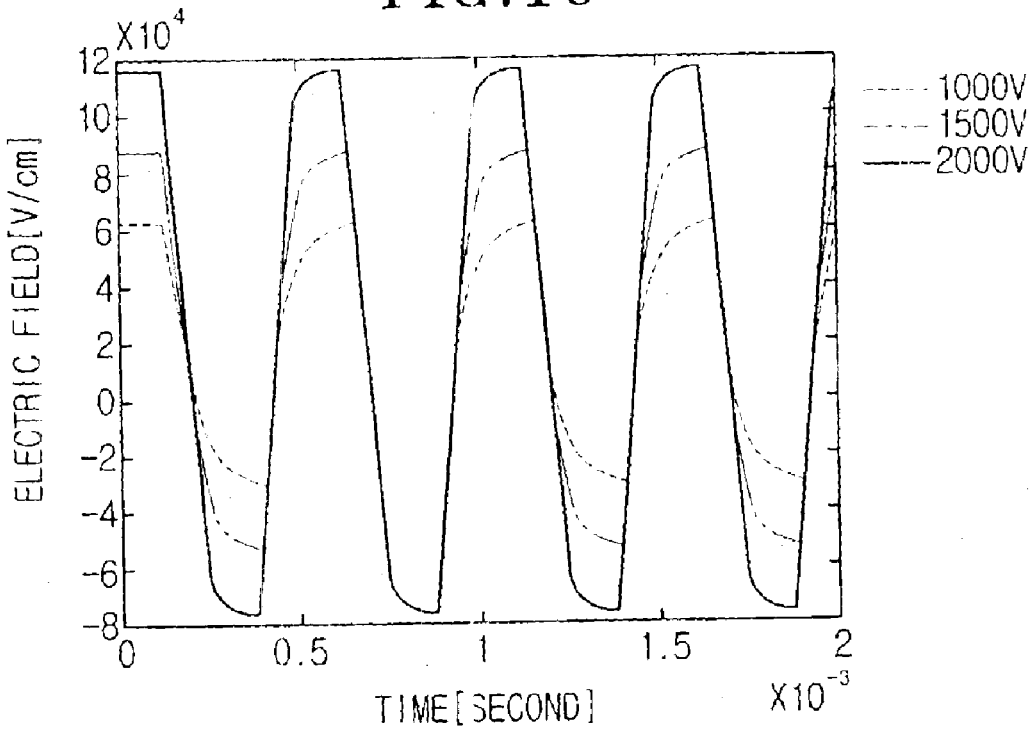
FIG. 10 is a view showing waveforms obtained from measurements of electric fields for developments according to different amplitudes of the AC voltages supplied to the developing rollers.
Figure 11:
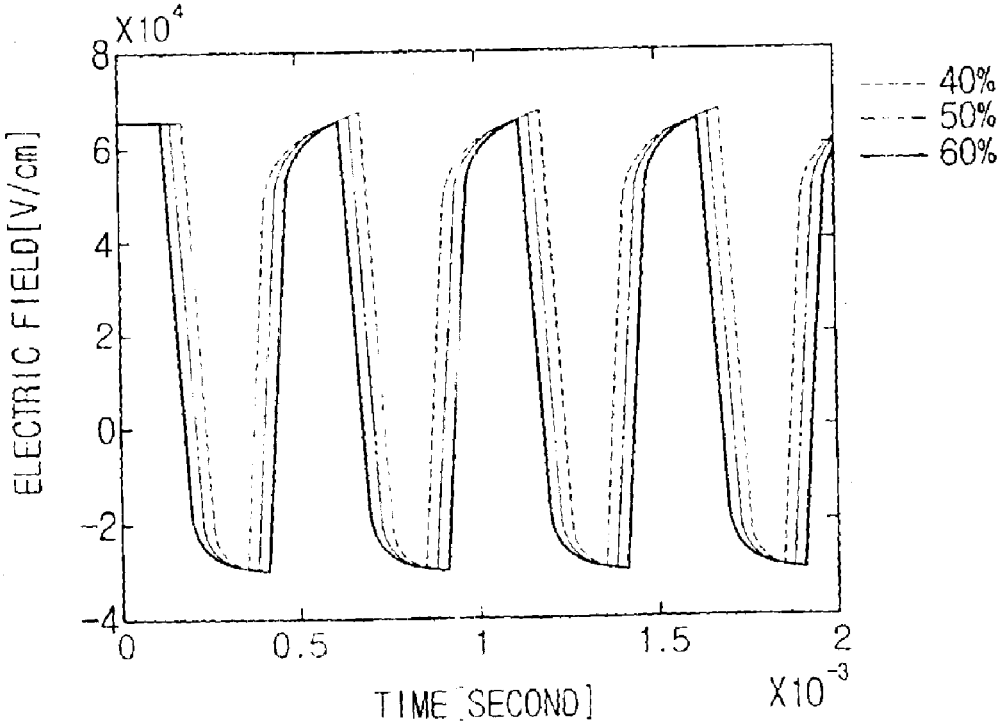
FIG. 11 is a view showing waveforms obtained from measurements of developing electric fields according to different duty ratios of the AC voltages supplied to the developing rollers.

The optimum developing bias conditions corresponding to the resistance R of the developing roller 131 and the developing gap g in the embodiments described above are experimentally obtained and recorded in the lookup table of the engine control part 230. That is, according to the experiments, if an AC voltage amplitude increases, a developing electric field formed in the developing gap g becomes stronger as shown in FIG. 10, and, if the duty ratio thereof increases, the developing electric field becomes weaker as shown in FIG. 11. Therefore, the optimum developing bias conditions corresponding to the resistance R of the developing roller 131 and the developing gap g are obtained in advance in consideration of the AC voltage amplitude and the duty ratio affecting the developing electric field and recorded in the lookup table.

That is, developing bias application data is experimentally obtained and recorded in the lookup table, which increases the AC voltage amplitude and decreases the duty ratio if a resistance value of the developing roller 131 becomes larger than a reference value which is an arbitrary reference resistance value, and decreases the AC voltage amplitude and increases the duty ratio if the resistance value of the developing roller 131 becomes smaller than the reference value.

Hereinafter, descriptions will be made on a process of calculating the resistance R of the developing roller 131 and the developing gap g in response to a rectangular test AC voltage, which is supplied to the developing roller 131, and then determining the developing bias driving condition from the calculation of the resistance R of the developing roller 131 and the developing gap g according to another embodiment of the present invention.

First, prior to a description on a driving bias determination process, characteristics based on rectangular AC voltages can be observed in FIGS. 12 to 15.

Figure 12:
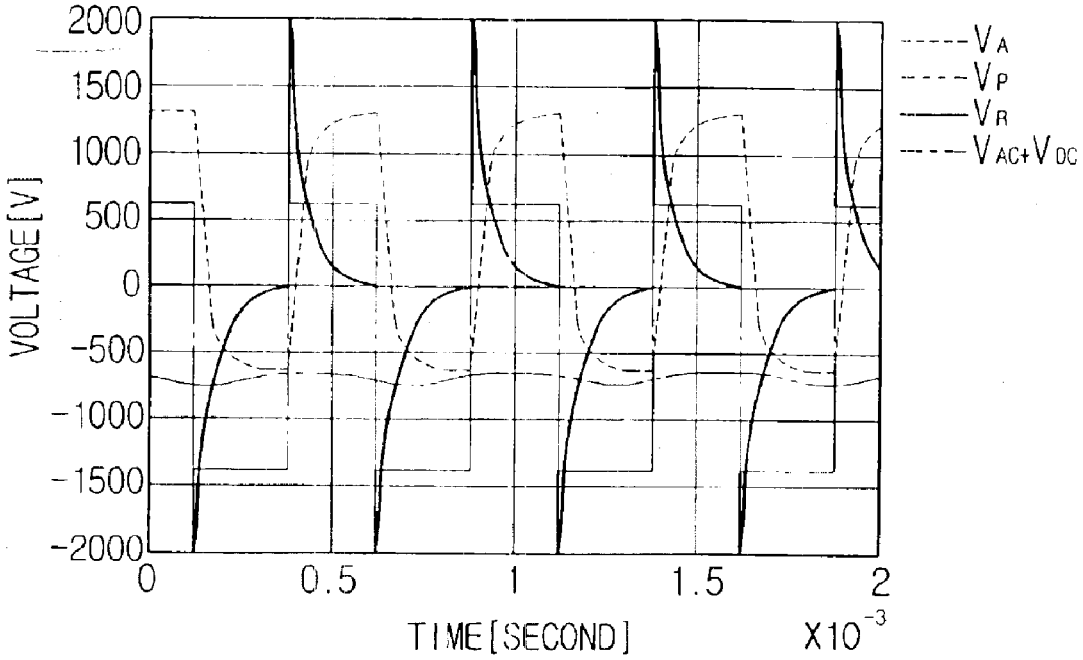
FIG. 12 is a view showing waveforms obtained through simulating voltage waveforms of respective elements of a current loop in response to a rectangular voltage($V_{AC}$+$V_{DC}$) formed with superimposed waveforms generated from the dc voltage source and the AC voltage source of FIG. 3.
Figure 13:
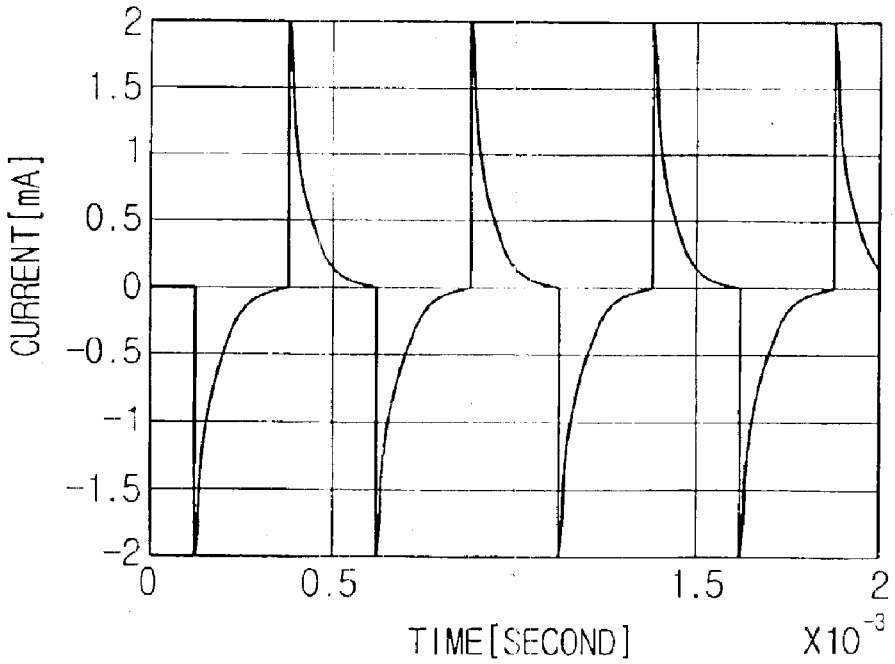
FIG. 13 is a view showing a waveform indicating a developing current measured in the bias application condition of the wave formed shown in FIG. 12.
Figure 14:
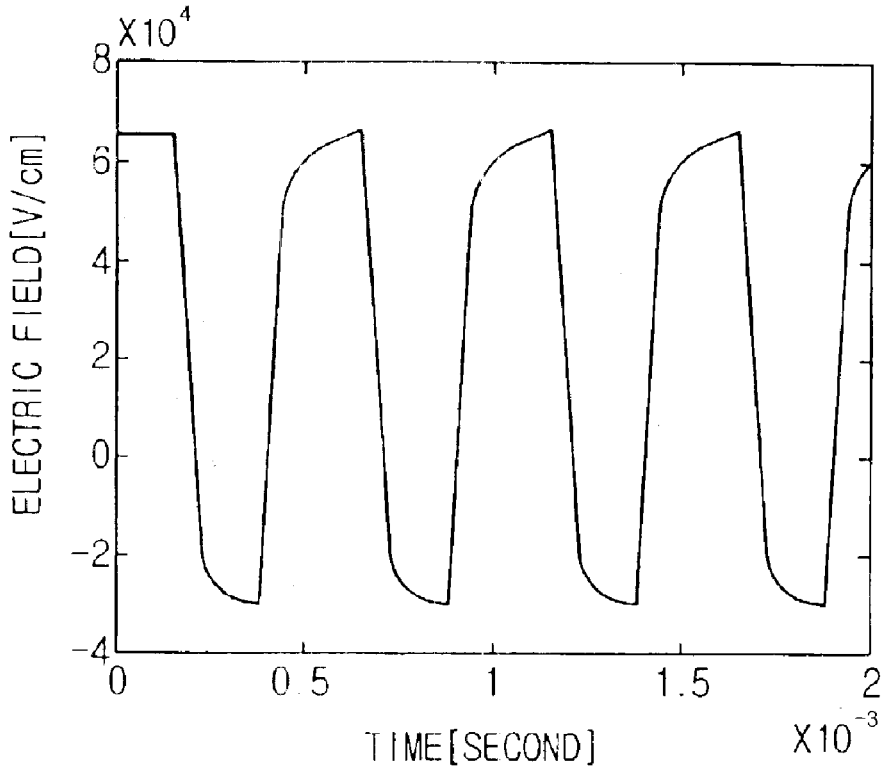
FIG. 14 is a view for showing a waveform obtained from measurements of a developing electric field in the bias application condition of the wave formed shown in FIG. 12.
Figure 15:
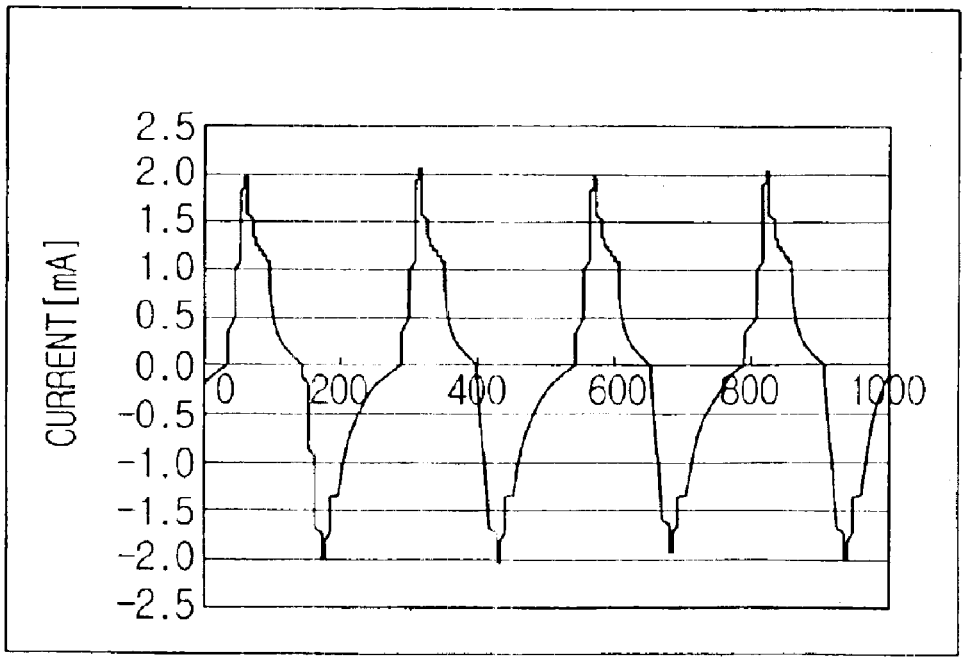
FIG. 15 is a view showing a waveform obtained from experimental measurements with a rectangular AC voltage in the printer of FIG. 1.

FIG. 12 shows voltage waveforms of respective elements in the equivalent circuit of FIG. 3 when the rectangular test AC voltage is supplied to the developing roller 131, and FIGS. 13 and 14 are waveforms of the developing current i(t) and the developing electric field corresponding to FIG. 12. FIG. 15 shows a developing current waveform experimentally obtained in order to verify whether simulation results of FIG. 13 substantially match. The comparison of FIG. 13 and FIG. 15 shows that an analysis based on the simulation of the equivalent circuit substantially matches.

Hereinafter, a process will be described which determines the developing bias driving condition using a time constant relation equation in accordance with the rectangular AC voltage.

First, the instant developing current i(t) is expressed in the following Formula 15 as a relation equation involving a time constant.

$$i(t) = I\exp(-t/\tau) = \frac{2V_{AMP}}{R}\exp(-t/\tau), \qquad \text{Formula 15}$$

wherein I denotes a peak value of the developing current i(t) and $V_{AMP}$ denotes the amplitude of the rectangular AC voltage.

In the meantime, the following Formula 16 expresses the resistance R of the developing roller 131 in a relation equation of the developing current i(t) and a driving voltage.

$$R = \frac{2V_{AMP}}{I}$$

Accordingly, the resistance R of the developing roller 131 is calculated using Formula 16 in accordance with a developing current value detected from the current detection part 220 and information on the rectangular AC voltage.

Meanwhile, the following Formula 17 expresses the time constant in instant developing current values of first and second times corresponding to a sequential and equal interval after the time at which a peak developing current is produced as to the instant developing current i(t):

$$\tau=(t_2-t_1)\ln(i(t_1)/i(t_2)) \qquad \text{Formula 17}$$

Therefore, the time constant can be obtained by using Formula 17, and a developing gap capacitance can be obtained using the following Formula 18.

$$C_A=\tau/R \qquad \text{Formula 18}$$

Further, the developing gap g can be calculated in accordance with the calculated developing gap capacitance $C_A$ substituted in preceding Formula 9.

Figure 16:
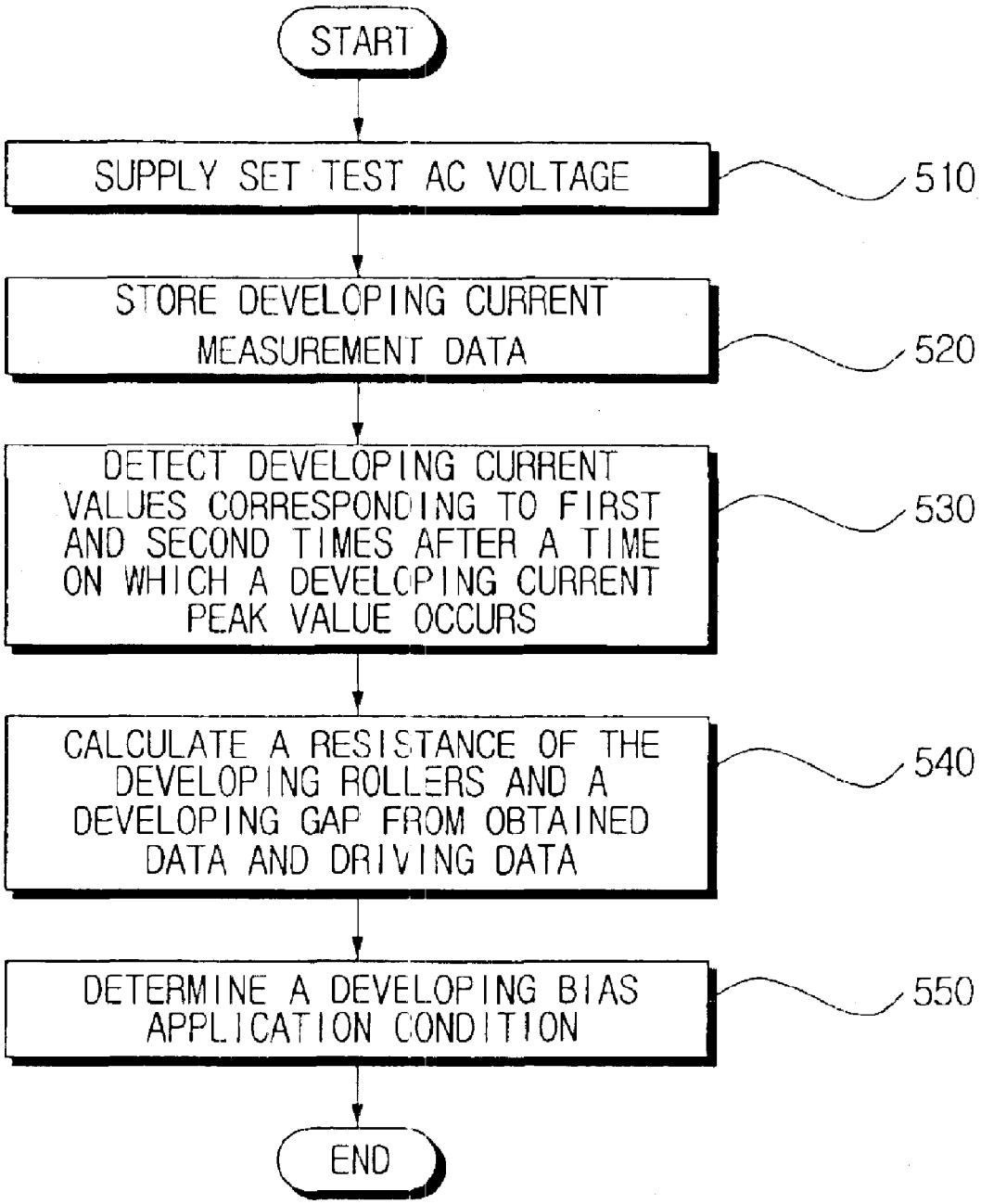
FIG. 16 is a flow chart showing a process determining a developing bias according to another embodiment of the present invention.

FIG. 16 shows a developing bias determination process based on the method described above. First, the engine control part 230 applies a set test AC voltage to the developing roller 131 in operation 510, and stores an instant developing current value including a maximum developing current value detected for the applied test AC voltage in operation 520).

The obtained developing current value is converted into a digital signal and stored in a memory (not shown) of the engine control part 230.

Next, when the time at which a developing current peak value occurs from the stored developing current data, the engine control part 230 extracts a first developing current value at a first time after the reference time and a second developing current value at a second time after the first time in operation 530.

Figure 17:
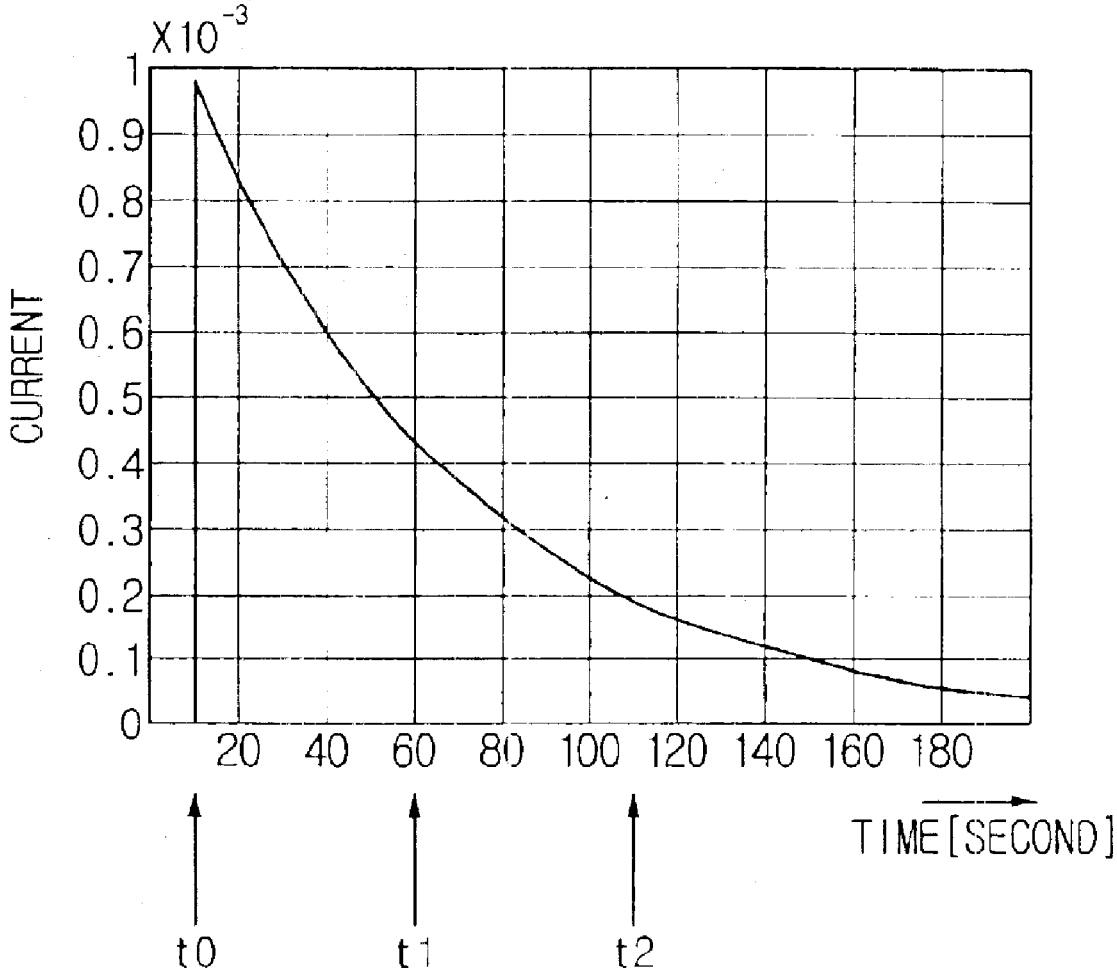
FIG. 17 is a view showing a waveform indicating a developing current obtained for a certain time period in accordance with a rectangular bias application in order to explain the process of determining the developing bias of the flow chart shown in FIG. 16.

Thereafter, by using the obtained data and the driving data information, the engine control part 230 calculates the resistance R of the developing roller 131 and the developing gap g based on the method described through preceding Formula 15 to Formula 18 in operation 540. That is, when developing current detection data as shown in FIG. 17 is obtained for a certain period of time and the time at which a current peak occurs is referred to as a reference time (t0), the engine control part 230 takes a current value matching with a first time (t1) and a second time (t2) corresponding to a time interval set from the reference time (t0) and calculates the resistance R of the developing roller 131 and the developing gap g.

Thereafter, the engine control part 230 determines the developing bias application condition corresponding to the calculated the resistance R of the developing roller 131 and the developing gap g in operation 550.

As described so far, the image forming apparatus and the control method thereof according to the present invention precisely calculate a resistance value of the developing roller and a developing gap, and determine a bias to be applied to the developing roller, thereby preventing the deterioration of a printing quality due to environment changes and parts characteristics variations.

Although the preferred embodiment of the present invention has been described, it will be understood by those skilled in the art that the present invention should not be limited to the described preferred embodiment, but various changes and modifications can be made within the spirit and scope of the present invention as defined by the appended claims and their equivalents.

What is claimed is:

1. An image forming apparatus having a developing roller mounted to be spaced with a photo-sensitive body and supplying a developing agent to the photo-sensitive body, and a bias-applying part applying a predetermined bias to the developing roller through a current-conducting path to the photo-sensitive body from the developing roller, further comprising:

a current detection part detecting a developing current flowing through the developing roller in response to the bias applied from the bias-applying part and generating a current value; and an engine control part controlling the bias-applying part to supply a first test AC voltage having a set first frequency to the developing roller and supply a second test AC voltage having a set second frequency to the developing roller, calculating a resistance of the developing roller and a developing gap between the developing roller and the photo-sensitive body in accordance with the current value detected from the current detection part respectively corresponding to the first and second AC voltages having the corresponding first and second frequencies, and controlling the bias-applying part to supply the developing roller with a bias voltage of a driving condition corresponding to the calculated resistance of the developing roller and the calculated developing gap.

2. A method of controlling an image forming apparatus having a developing roller mounted to be spaced with a photo-sensitive body and supplying a developing agent to the photo-sensitive body, and a bias-applying part applying a predetermined bias to the developing roller through a current-conducting path to the photo-sensitive body from the developing roller, the method comprising:

supplying a first test AC voltage having a set first frequency to the developing roller;

detecting a first developing current flowing through the developing roller corresponding to the first test AC voltage having the first frequency;

applying a second test AC voltage having a set second frequency to the developing roller;

detecting a second developing current flowing through the developing roller corresponding to the second test AC voltage having the second frequency;

calculating a resistance of the developing roller and a developing gap between the developing roller and the photo-sensitive body using data of the first and second test AC voltages and data of the first and second developing currents detected in response to the respective first and second test AC voltages; and supplying the developing roller with a bias voltage of a driving condition corresponding to the calculated resistance of the developing roller and the calculated developing gap.

3. An image forming apparatus having a developing roller mounted to be spaced with a photo-sensitive body and supplying a developing agent to the photo-sensitive body, and a bias-applying part applying a predetermined bias to the developing roller through a current-conducting path to the photo-sensitive body from the developing roller, comprising:

a current detection part detecting a developing current flowing through the developing roller in response to the bias supplied by the bias-applying part; and an engine control part controlling the bias-applying part to supply a set test AC voltage to the developing roller, calculating a resistance of the developing roller and a developing gap between the developing roller and the photo-sensitive body using information on a phase difference between the developing current outputted from the current detection part and the AC voltage, and controlling the bias-applying part to supply the developing roller with a bias of a driving condition corresponding to the calculated resistance of the developing rollers and the calculated developing gap.

4. A method of controlling an image forming apparatus having a developing roller mounted to be spaced with a photo-sensitive body and supplying a developing agent to the photo-sensitive body, a bias-applying part applying a predetermined bias to the developing roller through a current-conducting path to the photo-sensitive body from the developing roller, the method comprising:

applying a set test AC voltage to the developing roller;

detecting a developing current flowing through the developing roller in response to the test AC voltage;

calculating a resistance of the developing roller and a developing gap between the developing roller and the photo-sensitive body using information on a phase difference between the test AC voltage and the developing current; and supplying the developing roller with a bias of a driving condition corresponding to the calculated resistance of the developing roller and the calculated developing gap.

5. An image forming apparatus having a developing roller mounted to be spaced with a photo-sensitive body and supplying a developing agent to the photo-sensitive body, and a bias-applying part applying a predetermined bias to the developing roller through a current-conducting path to the photo-sensitive body from the developing roller, comprising:

a current detection part detecting a current flowing through the developing roller in response to the bias by the bias-applying part, and detecting first and second developing current values of the current corresponding to first and second time periods after a reference time at which a current peak value of the current occurs, respectively; and an engine control part controlling the bias-applying part to supply a set test AC voltage to the developing roller as the bias, calculating a resistance of the developing roller and a developing gap between the developing roller and the photo-sensitive body by analyzing data of the current and the first and second developing current values, and controlling the bias-applying part to supply the developing roller with a bias of a driving condition in accordance with the calculated resistance of the developing roller and the calculated developing gap.

6. A method of controlling an image forming apparatus having a developing roller mounted to be spaced with a photo-sensitive body and supplying a developing agent to the photo-sensitive body, and a bias-applying part supplying a predetermined bias to the developing roller through a current-conducting path to the photo-sensitive body from the developing roller, the method comprising:

supplying a set test AC voltage to the developing roller using the bias-applying part;

storing time data of a developing current flowing through the developing roller in response to the set test AC voltage;

detecting first and second developing current values corresponding to respective first and second time periods after a reference time at which a peak value of the current occurs in response to the test AC voltage;

calculating a resistance of the developing roller and a developing gap between the developing roller and the photo-sensitive body according to the first and second developing current values and time data; and supplying the developing roller with a bias of a driving condition corresponding to the calculated resistance of the developing roller and the calculated developing gap.

7. An image forming apparatus having a developing roller supplying a developing agent to the photo-sensitive body and a bias-applying part applying a predetermined bias to the developing roller through a current-conducting path to the photo-sensitive body from the developing roller, comprising:

a current detection part detecting a current flowing through the developing roller in response to the bias by the bias-applying part; and an engine control part controlling the bias-applying part to supply the developing roller with an AC voltage as the bias, calculating a resistance of the developing roller and a developing gap between the developing roller and the photo-sensitive body using the AC voltage and the detected current, and controlling the bias-applying part to supply the developing roller with another bias of a driving condition in accordance with the calculated resistance of the developing roller and the calculated developing gap between the developing roller and the photo-sensitive body.

8. The apparatus of claim 7, wherein the engine control part comprises a lookup table storing developing bias data corresponding to respective resistances of the developing roller and respective developing gaps between the developing roller and the photo-sensitive body, selects one of the stored developing bias data from the lookup table in accordance with the calculated resistance of the developing roller and the calculated developing gap, and controls the bias-applying part to supply the developing roller with the another bias of a driving condition in accordance with the selected one of the stored developing bias data.

9. The apparatus of claim 7, wherein the developing roller supplies the developing agent to the photo-sensitive body through the developing gap, and the engine control part calculates the developing gap from a developing gap capacitance of the developing gap using the AC voltage and the detected current.

10. The apparatus of claim 7, wherein the bias-applying part comprises:

a DC voltage source generating a DC voltage;

an AC voltage source generating the AC voltage superimposed with the DC voltage in response to a control of the engine control part and supplying the AC voltage to the developing roller; and a resistor having a first end connected between the DC voltage source and the current detection part and a second end connected to a voltage reference.

11. The apparatus of claim 10, wherein the bias applying part comprises a DC voltage source generating a DC voltage and an AC voltage source generating the AC voltage superimposed with the DC voltage in response to a control of the engine control part and supplying the AC voltage to the developing roller, and the current detection part comprises a current transformer connected to the bias-applying part to detect the current using an induction method.

12. The apparatus of claim 7, further comprising:

a key input part through which a developing condition adjustment mode is generated, wherein the engine control part generates a control signal in response to the developing condition adjustment mode of the key input part, the current detection part detects the current flowing through the developing roller in accordance with the control signal, and the bias-applying part supplies the developing roller with the AC voltage as the bias.

13. The apparatus of claim 7, wherein the engine control part generates a control signal for a developing condition adjustment mode, the current detection part detects the current flowing through the developing roller in accordance with the control signal, and the bias-applying part supplies the developing roller with the AC voltage as the bias.

14. The apparatus of claim 13, wherein the engine control part generates the control signal when a product assembly of the image forming apparatus is finished, when a replacement of parts of the image forming apparatus occurs, when a time period for use of the image forming apparatus expires, or when the number of sheets of paper for a printing job is greater than a set number.

15. The apparatus of claim 7, wherein the AC voltage comprises a first AC voltage having a first frequency and a second AC voltage having a second frequency, and the current comprises a first current and a second current in response to corresponding ones of the first and second AC voltages, respectively.

16. The apparatus of claim 15, wherein the engine control part calculates the resistance of the developing roller and the developing gap between the developing roller and the photo-sensitive body using the first and second AC voltages and the first and second currents.

17. The apparatus of claim 15, wherein the engine control part calculates the developing gap from a developing gap capacitance using the first and second frequencies.

18. The apparatus of claim 17, wherein the engine control part comprises:

a lookup table having developing bias data corresponding to respective developing gap capacitances, selects one of the developing bias data from the lookup table in accordance with the developing gap capacitance, and controls the bias-applying part to supply the developing roller with the another bias of the driving condition in accordance with the selected one of the developing bias data.

19. The apparatus of claim 17, wherein the engine control part comprises:

a lookup table having developing bias data corresponding to respective resistances of the developing roller, selects one of the developing bias data from the lookup table in accordance with the resistance of the developing roller, and controls the bias-applying part to supply the developing roller with the another bias of the driving condition in accordance with the selected one of the developing bias data.

20. The apparatus of claim 7, wherein the AC voltage comprises a first phase, and the current comprises a second phase.

21. The apparatus of claim 20, wherein the engine control part calculates the resistance of the developing roller and the developing gap between the developing roller and the photo-sensitive body using a difference between the first phase of the AC voltage and the second phase of the current.

22. The apparatus of claim 21, wherein the first phase of the AC voltage is a phase of a maximum value of the AC voltage, and the second phase of the current is a phase of a maximum value of the current during supplying the AC voltage to the developing roller.

23. The apparatus of claim 20, wherein the engine control part comprises:

a lookup table storing developing bias data corresponding to respective resistances of the developing roller and respective developing gaps between the developing roller and the photo-sensitive body, selects one of the stored developing bias data from the lookup table in accordance with the calculated resistance of the developing roller and the calculated developing gap, and controls the bias-applying part to supply the developing roller with the another bias of a driving condition in accordance with the selected one of the stored developing bias data.

24. The apparatus of claim 7, further comprising:

another developing roller supplying another developing agent to the photo-sensitive body, wherein the engine control part controlling the bias-applying part to supply the another developing roller with the AC voltage, receiving another developing current flowing through the another developing roller in response to the AC voltage supplied by the bias-applying part from the current detection part, calculating another resistance of the another developing roller and another developing gap between the another developing roller and the photo-sensitive body using the AC voltage and the detected another developing current, and controlling the bias-applying part to supply the another developing roller with another bias of the driving condition in accordance with the calculated another resistance of the another developing roller and the calculated another developing gap between the another developing roller and the photo-sensitive body.

* * * * *